US006670315B1

(12) United States Patent
Marlin et al.

(10) Patent No.: US 6,670,315 B1
(45) Date of Patent: Dec. 30, 2003

(54) LOW POLLUTION SOLVENTS AND EMULSIONS ESPECIALLY USEFUL IN CLEANING SOILS FROM PAINTED AND UNPAINTED METAL AND PLASTIC SURFACES

(75) Inventors: Lawrence J. Marlin, Lake Orion, MI (US); Bhanu D. Patel, Canton, MI (US)

(73) Assignee: Henkel Corporation, Gulph Mills, PA (US)

( * ) Notice: Subject to any disclaimer, the term of this patent is extended or adjusted under 35 U.S.C. 154(b) by 205 days.

(21) Appl. No.: 09/825,466

(22) Filed: Apr. 3, 2001

Related U.S. Application Data

(60) Provisional application No. 60/194,205, filed on Apr. 3, 2000.

(51) Int. Cl.[7] ..... C11D 3/43

(52) U.S. Cl. ..... 510/242; 510/241; 510/365; 510/417; 510/427; 510/428; 510/506

(58) Field of Search ..... 510/365, 426, 510/417, 506, 428, 427, 432, 241, 242

(56) References Cited

U.S. PATENT DOCUMENTS 3,764,544 A * 10/1973 Haworth ..... 510/281
3,923,701 A * 12/1975 Rutherford et al. ..... 510/174
4,540,448 A 9/1985 Gautier et al.
4,543,206 A * 9/1985 Adams ..... 510/118
4,870,103 A 9/1989 Röchling et al.
5,080,822 A * 1/1992 VanEenam ..... 510/365
5,080,831 A 1/1992 VanEenam
5,158,170 A 10/1992 Grengg et al.
5,227,402 A 7/1993 Röchling et al.
5,370,817 A * 12/1994 Weltman et al. ..... 510/407
5,419,848 A 5/1995 VanEenam
5,423,919 A * 6/1995 Dieter et al. ..... 134/8
5,585,340 A 12/1996 Held, III
5,585,341 A * 12/1996 Van Eenam ..... 510/365
5,676,764 A * 10/1997 Locklin et al. ..... 134/38
5,698,138 A * 12/1997 Visca et al. ..... 516/22
5,759,975 A * 6/1998 Maxwell ..... 510/203
5,961,731 A * 10/1999 Cooper-Trotter ..... 134/6
6,048,471 A 4/2000 Henry
6,187,736 B1 * 2/2001 Jarema ..... 510/245
6,306,943 B1 * 10/2001 Henry ..... 524/270

* cited by examiner

*Primary Examiner*—Gregory E. Webb
(74) *Attorney, Agent, or Firm*—Brooks Kushman P.C.

(57) ABSTRACT

Tertiary-butyl acetate does not produce vapors which are considered as hazardous or polluting as those of other common organic solvents. Accordingly, the present invention discloses a general purpose cleaning composition that is formed by emulsifying t-butyl acetate with water. In another embodiment of the present invention, a general purpose cleaning composition is formed by mixing t-butyl acetate with more traditional solvents. The present invention also discloses liquid compositions for direct use in cleaning metals, processes for preparing such liquid compositions, and processes for cleaning metal and/or plastic surfaces with a composition according to the invention.

34 Claims, No Drawings

LOW POLLUTION SOLVENTS AND EMULSIONS ESPECIALLY USEFUL IN CLEANING SOILS FROM PAINTED AND UNPAINTED METAL AND PLASTIC SURFACES

CROSS-REFERENCE TO RELATED APPLICATION

This application claims the benefit of U.S. provisional application Serial No. 60/194,205 filed Apr. 3, 2000.

BACKGROUND OF THE INVENTION

1. Field of the Invention

This application relates to low pollution solvents and emulsions especially useful in cleaning soils from painted and unpainted metal and plastic surfaces.

2. Background Art

Numerous manufacturing operations require that metal and/or plastic surfaces be cleaned from a variety of soils. Furthermore, these surface may or may not have coatings on them. Non-exclusive examples of soils include sealants and other adhesives extruded from joints, lubricants for surface finishing operations used in the manufacture of motor vehicles, lubricants used in forming objects that are not flat from metal sheets or coils, and ink from printing plates cleaning. Non-exclusive examples of surfaces requiring cleaning include purging reservoirs and any conduits of painting systems when the type and/or color of the paint needs to be changed.

In most instances, these soils are more readily removed by organic solvents than by purely inorganic solvents such as water. Most organic solvents, however, emit vapors some of which are legally classified as air pollutants and/or as hazardous to workers who breathe the vapors. Some of these compounds are referred to as volatile organic compounds (VOCs). Reactive VOCs are capable of reacting with hydroxyl radicals and ultraviolet light close to the ground to form a potentially dangerous smog. Though most smog is caused by automobile emissions, the industrial use of VOC is also a major contributor to the formation of smog. Halogenated hydrocarbons are also potentially useful solvents for many cleaning operations. However, halogenated hydrocarbons tend to deplete the ozone layer and are therefore undesirable. For this reason, the use of most organic solvents that are effective in removing the most common soils encountered during manufacturing, particularly vehicle manufacturing, is legally restricted and/or requires expensive pollution abatement equipment.

The utilization of VOCs may be decreased by the addition of organic solvents to various aqueous cleaning solutions. Such mixtures tend to have improved cleaning ability with respect to certain organic soils, inks, and greases. However, such mixtures tend to separate in layers when stored unagitated for extended periods of time. This phenomenon is undesirable in that it requires additional steps in the cleaning process.

Accordingly, an object of this invention is to provide alternative liquid materials that will effectively remove soils encountered in manufacturing but are less polluting than the organic solvents now in use that give the most effective removal of such soils. Other more detailed, alternative, and/or concurrent objects will be apparent from the description below.

SUMMARY OF THE INVENTION

It has been found that tertiary-butyl acetate (hereinafter usually abbreviated as "t-butyl acetate") can be mixed with more traditional solvents and/or emulsified with water to provide an effective solvent for general cleaning during manufacturing, particularly motor vehicle manufacturing. These alternative t-butyl acetate-containing solvents have hazard and/or pollution potentials substantially lower than the traditional solvents because t-butyl acetate produces vapors which are considered to be less hazardous or polluting than the traditional solvents. Various embodiments of the invention include liquid compositions for direct use in cleaning metals, processes for preparing such liquid compositions, and processes for cleaning metal and/or plastic surfaces with a composition according to the invention.

DETAILED DESCRIPTION OF THE PREFERRED EMBODIMENTS

Reference will now be made in detail to presently preferred embodiments and methods of the invention, which constitute the best modes of practicing the invention known to the inventors.

All numerical quantities in this description indicating amounts of material or conditions of reaction and/or use are to be understood as modified by the word "about" in describing the broadest scope of the invention. Practice within the numerical limits stated is generally preferred. Also, unless expressly stated to the contrary, percent, "parts of", and ratio values are by weight. Furthermore, the description of a group or class of materials as suitable or preferred for a given purpose in connection with the invention implies that mixtures of any two or more of the members of the group or class are equally suitable or preferred. Finally, description of constituents in chemical terms refers to the constituents at the time of addition to any combination specified in the description, and does not necessarily preclude chemical interactions among the constituents of a mixture once mixed.

In an embodiment of the present invention, a cleaning liquid composition is provided. The cleaning liquid composition of this embodiment is preferably an emulsion, and more preferably a microemulsion that is either translucent or transparent. The cleaning liquid composition comprises t-butyl acetate in an amount of about 10 to 65 percent of the total weight of the cleaning liquid composition. More preferably, the t-butyl acetate is present in an amount of about 20 to 60 percent of the total weight of the cleaning liquid composition and most preferably about 30 to 55 percent of the total weight of the cleaning liquid composition. The cleaning liquid composition further comprises water and one or more emulsifying agents. The water is present in an amount of 5 to 80% of the total weight of the cleaning liquid composition, more preferably 20 to 60% of the total weight of the cleaning liquid composition, and most preferably 30 to 50% of the total weight of the cleaning liquid composition. If the concentration of water is too large, the working liquid cleaning composition is not likely to be as effective as desired in removing many of the soils encountered during motor vehicle manufacturing, while if the concentration of water is too low, there will be little or no advantage of lower cost and/or greater viscosity (which allows the working liquid cleaning composition to be used more easily on sloping surfaces) gained by including the water.

Tertiary-butyl acetate is commercially available from Lyondell Chemical Company (Houston, Tex.). The synthesis of t-butyl acetate is well known and is described, for example, in U.S. Pat. Nos. 5,994,578; 6,018,076; and 6,194,602.

The concentration of emulsifying agent in a working liquid cleaning composition according to this invention is preferably 1 to 40% of the total weight of the cleaning liquid composition, more preferably, from 8 to 35% of the total weight of the cleaning liquid composition, and most preferably from 15 to 30% of the total weight of the cleaning liquid composition. If the concentration of emulsifying agent is too high, the cost of the working liquid cleaning composition will be uneconomical, while if the concentration of emulsifying agent is too low, the stability of the emulsion will be at risk. The emulsifying agent(s) are present in a sufficient quantity to form a stable emulsion of all of the constituents of the cleaning liquid. A stable emulsion is one that does not develop any appreciable amount of a separate phase detectable with normal human vision when stored at 25° C. without mechanical disturbance for a time period from 10 to 50 hours. More preferably, the cleaning liquid does not develop any separate phase detectable with normal human vision when stored at 25° C. without mechanical disturbance for a time period from 100 to 300 hours, and most preferably does not develop any separate phase detectable with normal human vision when stored at 25° C. without mechanical disturbance for a time period from 500 to 1000 hours. Furthermore, the cleaning liquid does not develop any separate phase detectable with normal human vision that constitutes more than 5% of the total volume so stored, more preferably the cleaning liquid does not develop any separate phase detectable with normal human vision that constitutes more than 3% of the total volume so stored, and most preferably the cleaning liquid does not develop any separate phase detectable with normal human vision that constitutes more than 1% of the total volume so stored.

Preferably, the emulsifying agent(s) used to emulsify t-butyl acetate and water together in a working liquid cleaning composition according to the invention comprises at least one nonionic surfactant. Preferably, the nonionic surfactants are selected from the group of such surfactants for which each molecule has both a hydrophobic moiety portion and a hydrophilic moiety portion. The hydrophobic moiety portion contains at least one hydrocarbon group. Suitable hydrocarbon groups include alkyl groups, cycloalkyl groups, aryl group, alkylaryl groups, and the like. The hydrocarbon group may be a branched or straight chain group. Preferably, the hydrophobic moieties contain at least one carbon-carbon bond that is a double or triple bond or part of an aromatic ring. Each hydrocarbon group preferably has from 10 to 50 carbon atoms, more preferably from 12 to 30 carbon atoms, and most preferably from 15 to 20 carbon atoms. The hydrophilic moiety preferably is a hydrophilic polyaklylane ether moiety, preferably a moiety which conforms to the general chemical formula $—(C_2H_4O)_n—$, where n represents a positive integer that is at least 3. Suitable surfactants include but are not limited to TOMAH E-14-5 (poly (5) oxyethylene isodecyloxypropylamine) and TOMAH E-14-2 commercially available from Tomah Products Inc. located in Milton, Wis.; NINOL 11CM (a modified coconut diethanolamide surfactant sold by Stepan, Inc.) TRITON X-100 (octylphenol ethylene oxide condensate; Octoxynol-9) commercially available from Union Carbide; and APG 325 CS (decyl polyglucoside) commercially available from Cognis Corporation located in Cincinnati, Ohio.

Other suitable non-ionic surfactants include block surfactants containing polyoxypropylene hydrophobe(s) and polyoxyethylene hydrophile(s). The blocks may be homopolymeric or copolymeric, for example copolymers derived from oxyalkylating with mixtures of ethylene oxide and propylene oxide. Such surfactants are available from numerous sources, including the Pluronic®, Tetronic®, and Pluronic® R polyether surfactants from BASF Corporation. The HBL of these surfactants may be readily altered by adjusting the relative lengths of the hydrophobe(s) and hydrophile(s).

The cleaning liquid composition of the present invention optionally includes organic substances other than t-butyl acetate itself. These organic substances form mixtures with t-butyl acetate and any other constituents of the cleaning liquid composition, that are molecularly homogeneous solutions and are liquid at the temperature of intended use or, if the temperature of intended use is not specified, are liquid at 25° C. The organic substances other than t-butyl acetate preferably are selected from the group consisting of hydrocarbons, halohydrocarbons, halocarbons, ethers, and mixtures thereof. These other organic substances are preferably present in an amount of 35 to 90% of the total weight of the cleaning liquid composition, more preferably in an amount from 40 to 80% of the total weight of the cleaning liquid composition, and most preferably in an amount of 45 to 70% of the total weight of the cleaning liquid composition. Independently, these organic substances other than t-butyl acetate preferably are selected from the group of organic materials that are liquid at 25° C. and have a boiling point at normal atmospheric pressure greater than 80° C., more preferably greater than 90° C., and most preferably greater than 100° C. Preferred organic substances other than t-butyl acetate include saturated hydrocarbons constituted of molecules that preferably having from 6 to 20 carbon atoms, more preferably from 6 to 15 carbon atoms, and most preferably from 7 to 8 carbon atoms.

The cleaning liquid of the present invention optionally includes coupling or coalescing agents (sometimes also referred to as co-solvents) as needed to improve the solubility in water of any of the organic substances present in said cleaning liquid. The co-solvents or coupling agents which may be utilized in the practice of the present invention include sodium benzene sulfonate, sodium toluene sulfonate, sodium xylene sulfonate, potassium ethylbenzene sulfonate, sodium cumene sulfonate, sodium octane-1-sulfonate, potassium dimethylnaphthalene sulfonate, ammonium xylene sulfonate, sodium n-hexyl diphenyloxide disulfonate, sodium 2-ethylhexyl sulfate, ammonium n-butoxyethyl sulfate, sodium 2-ethylhexanoate, sodium pelargonate, sodium n-butoxymethyl carboxylate, potassium mono/di phenoxyethyl phosphate, sodium mono/di n-butoxyethyl phosphate, triethanolamine trimethylolpropane phosphate, sodium capryloamphopropionate, disodium capryloiminodipropionate, and sodium capro imidazoline amphoglycinate. Certain solvents can also function as coalescing agents and useful coalescing agents include the ethylene and propylene derived glycol ether solvents of which the most preferred are the propylene glycol ethers. The preferred coalescing agents include Dowanol™ diethylene glycol n-butyl ether (DB), ethylene glycol n-butyl ether (EB), ethylene glycol phenyl ether (EPh), and propylene glycol n-propyl ether (PnP) (Dow Chemical Co.). The more preferred coalescing agents include propylene glycol phenyl ether (PPh), and propylene glycol n-butyl ether (PNB).

In a particularly preferred embodiment of the present invention, the emulsifying agent in a working liquid cleaning composition includes a first surfactant that is at least partly nonionic and a distinct second surfactant that is entirely nonionic. The nonionic part of the first surfactant preferably has a hydrophilic-lipophilic-balance (hereinafter usually abbreviated as "HLB") value in the range of 12 to 20. More preferably, the HLB value is from 14 to 18, and most preferably from 15 to 16. A preferred material for the nonionic part of the first surfactant is TWEEN™ 80 available from ICI in Wilmington, Del., which is the condensation product of sorbitan mono-oleate reacted with ethylene oxide in a molecular ratio of 20 molecules of ethylene oxide per molecule of sorbitan monooleate. In this embodiment, non-ionic surfactants may be used for the first and second surfactant, however, excellent results can also be obtained with a first surfactant in which up to 50% consists of anionic surfactant. A preferred anionic surfactant is an amine salt of an alkylaryl sulfonic acid. In this preferred type of anionic surfactant, the alkylaryl group preferably has from 8 to 24 carbon atoms. More preferably, the alkylaryl group has from 10 to 20 carbon atoms, and most preferably from 12 to 16 carbon atoms. The alkyl moiety preferably does not contain double bonds; the amine preferably is a primary amine; and the total number of carbon atoms per amine molecule is at least 2, or more preferably at least 3. The single most preferred anionic surfactant is the iso-propyl amine salt of dodecylbenzene sulfonic acid. Suitable sources for this anionic surfactant include NINATE 411 commercially available from Stepan Company.

In this embodiment, the second, fully nonionic surfactant preferably has an HLB value from 6 to 12, more preferably from 7 to 11, and most preferably from 8 to 10. A preferred material for the second nonionic surfactant is the condensation product of dinonyl phenol with ethylene oxide. A suitable source for this condensation product is IGEPAL™ DM-530 available from GAF Corporation of Wayne, N.J., a commercially supplied surfactant reported by its supplier to have an HLB value of 10.6 and to consist of products of reaction between ethylene oxide and dinonyl phenol. When the emulsifying agent comprises distinct first and second surfactants as described in detail above, the ratio by weight of the second to the first nonionic surfactant is preferably 0.03/1.00 to 1.00/1.00, more preferably 0.3/1.00 to 0.8/1.00, and most preferably 0.49/1.00 to 0.51/1.00. Furthermore, the first surfactant may optionally include an anionic surfactant in an amount of 10% to 70%, more preferably in an amount of 30% to 60%, and most preferably in an amount of 40% to 50% of the total weight of the first surfactant. The ratio by weight of the second to the first nonionic surfactant in this instance is preferably 0.3/1.00 to 0.7/1.00, more preferably 0.40/1.00 to 0.6/1.00, and most preferably 0.4/1.00 to 0.5/1.00.

A preferred process for making an emulsion type working liquid cleaning composition according to the invention comprises:

(1) mixing the t-butyl acetate and a first surfactant to form a first homogeneous mixture;

(2) while continuing mixing, adding the water content of the intended final working liquid cleaning composition slowly to the mixture formed in step (1) as recited immediately above to form a second homogeneous mixture; and (3) while continuing to mix, adding a second surfactant to the mixture formed in step (2) as recited immediately above, to form a third homogeneous mixture.

Additional surfactants may be added to the third homogenous mixture as desired to form the final liquid cleaning composition On a laboratory scale, the mixing may be accomplished with an ordinary mechanical stirrer. In a particular embodiment of the present invention, the mixing speed of step (1) is preferably from 100 to 3000 rpm, more preferably from 1000 to 2500 rpm, and most preferably from 1500 to 2000 rpm. Similarly, in this particular embodiment, the mixing speed at steps (2) and (3) is preferably 3200 to 6500 rpm, more 4000 to 6000 rpm, and most preferably 4500 to 5500 rpm. Those skilled in the art will be readily able, with minimal experimentation, to determine optimum conditions for a similar process on a commercial scale.

In another embodiment of the present invention, a process for making an emulsion type liquid cleaning composition that includes two or more surfactants is provided. The process comprises:

(1) mixing a first surfactant and water to form a first homogeneous mixture;

(2) while continuing mixing, adding t-butyl acetate to the mixture formed in step (1) as recited immediately above to form a second homogeneous mixture; and (3) while continuing mixing, adding a second surfactant to the mixture formed in step (2) as recited immediately above to form a third homogeneous mixture.

Additional surfactants may be added to the third homogenous mixture as desired to form the final liquid cleaning composition. Again, on a laboratory scale, the mixing may be accomplished with an ordinary mechanical stirrer. Mixing must be of a sufficient speed and duration to completely mix the incredients. The precise mixing speed will be dependent on the exact surfactants to be mixed.

In another embodiment of the present invention, a cleaning liquid composition is provided. The cleaning liquid composition comprises t-butyl acetate in an amount of about 10 to 65 percent of the total weight of the liquid cleaning composition. More preferably, the t-butyl acetate is present in an amount of about 20 to 60 percent of the total weight of the liquid cleaning composition and most preferably about 30 to 55 percent of the total weight of the liquid cleaning composition. The cleaning liquid further comprises organic substances other than t-butyl acetate. The organic substances other than t-butyl acetate preferably are selected from the group consisting of hydrocarbons, halohydrocarbons, halocarbons, ethers, and mixtures thereof. The organic substance other than t-butyl acetate are preferably present in an amount of 35 to 90% of the total weight of the cleaning liquid composition, more preferably in an amount from 40 to 80% of the total weight of the cleaning liquid composition, and most preferably in an amount of 45 to 70% of the total weight of the cleaning liquid composition. Independently, these organic substances other than t-butyl acetate preferably are selected from the group of organic materials that are liquid at 25° C. and have a boiling point at normal atmospheric pressure greater than 80° C., more preferably greater than 90° C., and most preferably greater than 100° C. Preferred organic substances other than t-butyl acetate include saturated hydrocarbons constituted of molecules that preferably have from 6 to 20 carbon atoms, more preferably from 6 to 15 carbon atoms, and most preferably from 7 to 8 carbon atoms.

In yet another embodiment of the present invention, a process for cleaning a metal and/or plastic surface is disclosed. The process comprises contacting a soiled surface with a suitable composition according to the invention as described above for a sufficient time at a sufficiently high temperature to achieve the desired amount of soil removal. Contacting between the surface and the liquid composition according to the invention may be accomplished by any convenient method, such as immersing the surface in a container of the liquid composition, spraying the composition on the surface, wiping the composition on the surface, or the like, or by a mixture of methods. Any temperature between just above the freezing point and just below the boiling point of the liquid cleaning composition may generally be used, with a temperature of 20° C. to 60° C. generally preferred and 25° C.–50° C. being more preferred. At these preferred temperatures, a time of contact from 20–120 seconds is generally preferred for spraying applications, with from 45–90 being seconds more preferred. For immersion applications, a time of contact from 40–240 seconds is generally preferred, with 90–180 seconds being more preferred. For particularly soiled surfaces, the surface is preferably contacted with the liquid cleaning composition for at least 5 miuntes, more preferably for at least 10 minutes, and most preferably for at least 20 minutes.

After cleaning as described immediately above, it is generally preferred to rinse the cleaned surface with water to remove any residue of the cleaning composition before subsequent use or surface finishing of the cleaned plastic. Most preferably, at least the last such rinse should be with deionized or other purified water. Usually, the rinsed surface should then be dried before subsequent finishing treatments. Drying also may be accomplished by any convenient method, such as a hot air oven, exposure to infra-red radiation, microwave heating, or the like.

For a variety of reasons, it is sometimes preferred that compositions according to the invention as defined above should be substantially free from any ingredients used in compositions for similar purposes in the prior art. Specifically, it is preferred, that independently that each preferably minimized component listed below is less than 10% of the total weight of the liquid cleaning composition of the present invention, more preferably less that 3% of the total weight of the liquid cleaning composition of the present invention, and most preferably less than 1% of the total weight of the liquid cleaning composition of the present invention: any acid or alkaline material that is not a surfactant, or more preferably not a nonionic surfactant; simple and complex halide anions; nitrate; halates and perhalates (i.e. perchlorate, chlorate, iodate, etc.); organic compounds containing nitro groups; organic molecules each of which contains at least two moieties selected from the group consisting of carboxyl, carboxylate, peroxy, keto, aldehydo, amino, amido, substituted amido, nitrile, substituted amino, thio, ether, thioether, phosphino, and substituted phosphino moieties; hexavalent chromium; manganese in a valence state of four or greater; and cations of elements other than alkaline earth and alkali metals. Even though components such as these may not be harmful in some cases, they have not been found to be needed or advantageous in compositions according to this invention, and their minimization will therefore normally be preferred for economy if for no other reason.

The practice of this invention may be further appreciated by consideration of the following, non-limiting, working examples.

EXAMPLE 1

Tertiary-butyl acetate in an amount of 90 grams (hereinafter usually abbreviated as "g") is mixed by stirring at 1500 to 2000 rpm for 5 to 10 minutes with 20 g of TWEEN™ 80, a commercially supplied surfactant reported by its supplier to have an HLB value of 15.0. After these materials are thus thoroughly mixed, 60 g of deionized water is added slowly while stirring at 3000 to 5000 rpm until the full amount had been added. Finally, while still stirring at high speed, 5.0 g of IGEPAL™ DM-530, a commercially supplied surfactant reported by its supplier to have an HLB value of 10.6 and to consist of products of reaction between ethylene oxide and dinonyl phenol, is added. The product is a creamy, off-white colored, translucent liquid. After storage for 96 hours, approximately 0.5% of the volume of the liquid had formed a separate phase floating on top of the remainder; this floating layer could readily be stirred back into the remainder of the liquid and remain without visually perceptible phase separation for at least several hours.

A portion of the creamy liquid thus prepared is tested along with D-limonene for removing an adhesive on aluminum that is now commonly cleaned with D-limonene in commercial motor vehicle manufacturing. The creamy liquid according to the invention removed the adhesive at least as well as the D-limonene. The liquid according to the invention is readily rinsed away with tap water, while the D-limonene could be removed from the surface only with difficulty by this means.

EXAMPLE 2

Tertiary-butyl acetate in an amount of 90 g is mixed by stirring at 1500 to 2000 rpm for 5 to 10 minutes with 5.0 g of TWEEN™ 80 and 5.0 g of NINATE™ 411, a commercially supplied surfactant reported by its supplier to consist of molecules of the iso-propyl amine salt of dodecylbenzene sulfonic acid. After these materials are thus thoroughly mixed, 60 g of deionized water are added slowly while stirring at 3000 to 5000 rpm until the full amount had been added. Finally, while still stirring at high speed, 5.0 g of IGEPAL™ DM-530 are added. The product is a creamy, off-white colored, translucent liquid.

EXAMPLE 3

A mixture of 50% t-butyl acetate and 50% of hydrotreated light petroleum distillate is prepared and formed an apparently molecularly homogeneous solution (the mixture had no turbidity or other visually apparent evidence of phase separation). The hydrotreated light petroleum distillate contains 98% of saturated hydrocarbons with 7 or 8 carbon atoms per molecules, ≦0.3% of toluene, ≦1.6% of xylene(s), and ≦0.3% of ethyl benzene. This mixture according to the invention is as effective in removing a wide variety of soils encountered in motor vehicle manufacturing as are the non-ester containing organic solvents now commonly used. The mixture according to the invention has considerably less potential for pollution.

EXAMPLE 4

Ninate™ 411 in an amount of 40 grams is mixed by stirring at 1500 to 2000 rpm for 5 to 10 minutes with 115 g of deionized water. After these materials are thus thoroughly mixed, 160 g of t-butyl acetate is added slowly while stirring at 1500 to 2000 rpm for approximately 15 minutes. Next, 5 grams of APG 325 Glucoside is added while maintaining the mixing for an additional 5 minutes. Glycol ether (PnB) is added in an amount of 40 grams. Finally, 55 grams of ammonium xylene sulfonate is added over approximately 15 minutes. The product is a clear liquid. This mixture according to the invention is effective in removing a wide variety of soils from plastic and metal surfaces.

EXAMPLE 5

Tertiary-butyl acetate in an amount of 94.3 g is mixed by stirring at 1000 to 1500 rpm for 5 to 10 minutes with 21 g of TWEEN™ 80. After these materials are thus thoroughly mixed, 93 g of deionized water is slowly added while maintaining stirring at the same rate. The resulting mixture is stirred for approximately 15 minutes from the instant the deionized water is added. NINATE™ 11-CM in an amount of 13.6 g is slowly while maintaining the same mixing rate. Stirring is continued for an additional 5 to 10 minutes from the time the NINATE™ 11-CM. While continuing to maintain the same stirring rate, 6.6 gram of Tomah E-14-5 is slowly added over approximately 10 minutes, then 6.6 g of Tomah E-14-2 is added over the next 10 minutes, and then 4.0 grams of Triton X-100 is added the next 10 minutes. Finally, while continuing to maintain the same stirring rate, 4 g of IGEPAL™ DM-530 is added and stirring is maintained for an additional 15 minutes. The product is a clear liquid. This mixture according to the invention is effective in removing a wide variety of soils from plastic and metal surfaces.

EXAMPLE 6

Ninate™ 411 in an amount of 40 grams is mixed by stirring at 1500 to 2000 rpm for 5 to 10 minutes with 115 g of deionized water. After these materials are thus thoroughly mixed, 160 g of t-butyl acetate is added slowly while stirring at 1500 to 2000 rpm for approximately 15 minutes. Next, 5 grams of APG 325 Glucoside is added while maintaining the mixing for an additional 5 minutes. Glycol ether (PnB) is added in an amount of 40 grams. Next 83 grams of D-limonene is added while maintaining stirring for an additional 5 minutes. Finally, 55 grams of ammonium xylene sulfonate is added over approximately 15 minutes. The product is a clear liquid. This mixture according to the invention is effective in removing a wide variety of soils from plastic and metal surfaces.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A liquid cleaning composition for cleaning soil from a metallic or plastic substrate, the liquid cleaning composition comprising:

t-butyl acetate;

water; and at least one emulsifying agent wherein the emulsifying agent is present in sufficient quantity to form a stable emulsion of all constituents of the cleaning liquid composition when stored.

2. The liquid cleaning composition of claim 1, wherein the t-butyl acetate is present in an amount of about 10% to 65% of the total weight of the liquid cleaning composition.

3. The liquid cleaning composition of claim 1, wherein the t-butyl acetate is present in an amount of about 20% to 60% of the total weight of the liquid cleaning composition.

4. The liquid cleaning composition of claim 1, wherein the at least one emulsifying agent is present in an amount of about 1% to 40% of the total weight of the liquid cleaning composition.

5. The liquid cleaning composition of claim 1, wherein the at least one emulsifying agent is present in an amount of about 8% to 35% of the total weight of the liquid cleaning composition.

6. The liquid cleaning composition of claim 1, wherein the at least one emulsifying agent is present in an amount of about 15% to 30% of the total weight of the liquid cleaning composition.

7. The liquid cleaning composition of claim 1, wherein the at least one emulsifying agents comprises a nonionic surfactant.

8. The liquid cleaning composition of claim 7, wherein the nonionic surfactants are selected from the group consisting of surfactants that have both a hydrophobic moiety portion and a hydrophilic moiety portion.

9. The liquid cleaning composition of claim 8, wherein the hydrophobic moiety portion has from 10 to 50 carbon atoms and the hydrophilic moiety portion conforms to the general chemical formula $—(C_2H_4O)_n—$, where n is a positive integer that is at least 3.

10. The liquid cleaning composition of claim 1, wherein the at least one emulsifying agent comprises:

a first surfactant mixture; and a second surfactant mixture wherein the first surfactant mixture is different than the second surfactant mixture.

11. The liquid cleaning composition of claim 10, wherein the first surfactant mixture comprises an anionic surfactant and a first nonionic surfactant and the second surfactant mixture comprises a second nonionic surfactant wherein the first nonionic surfactant is different than the second nonionic surfactant.

12. The liquid cleaning composition of claim 11, wherein the anionic surfactant is present in an amount of about 10 to 60% and the nonionic surfactant is present in an amount of about 10% to 60%.

13. The liquid cleaning composition of claim 1 further comprising at least one organic substance, other than t-butyl acetate itself, that forms mixtures, together with t-butyl acetate and any other constituents of the cleaning liquid composition, that are molecularly homogeneous solutions and are liquid at 25° C.

14. The liquid cleaning composition of claim 13, wherein the at least one organic substance is selected from the group consisting of hydrocarbons, halohydrocarbons, halocarbons, ethers, and mixtures thereof.

15. The liquid cleaning composition of claim 1 further comprising a coupling agent.

16. The liquid cleaning composition of claim 15, wherein the coupling agent is selected from the group consisting of sodium benzene sulfonate, sodium toluene sulfonate, sodium xylene sulfonate, potassium ethylbenzene sulfonate, sodium cumene sulfonate, sodium octane-1-sulfonate, potassium dimethylnaphthalene sulfonate, ammonium xylene sulfonate, sodium n-hexyl diphenyloxide disulfonate, sodium 2-ethylhexyl sulfate, ammonium n-butoxyethyl sulfate, sodium 2-ethylhexanoate, sodium pelargonate, sodium n-butoxymethyl carboxylate, potassium monophenoxyethyl phosphate, potassium diphenoxyethyl phosphate, sodium mono-n-butoxyethyl phosphate, sodium di-n-butoxyethyl phosphate, triethanolamine trimethylolpropane phosphate, sodium capryloamphopropionate, disodium capryloiminodipropionate, sodium capro imidazoline amphoglycinate, and mixtures thereof.

17. A liquid cleaning composition for cleaning soil from a metallic or plastic substrate, the liquid cleaning composition comprising:

t-butyl acetate present in an amount of about 30% to 55% of the total weight of the liquid cleaning composition; and at least one organic substance, other than t-butyl acetate itself, that forms mixtures, together with t-butyl acetate and any other constituents of the cleaning liquid composition, that are molecularly homogeneous solutions and are liquid at 25° C.

18. The liquid cleaning composition of claim 17, wherein the at least one organic substance, other than t-butyl acetate itself, is present in an amount of about 35% to 70% of the total weight of the liquid cleaning composition.

19. The liquid cleaning composition of claim 17, wherein the at least one organic substance is selected from the group consisting of hydrocarbons, halohydrocarbons, halocarbons, ethers, and mixtures thereof.

20. A liquid cleaning composition for cleaning soil from a metallic or plastic substrate, the liquid cleaning composition comprising:

t-butyl acetate present in an amount of about 30% to 55% of the total weight of the liquid cleaning composition;

water; and at least one emulsifying agent wherein the emulsifying agent is present in sufficient quantity to form a stable emulsion of all constituents of the cleaning liquid composition when stored.

21. The liquid cleaning composition of claim 20, wherein the at least one emulsifying agent is present in an amount of about 1% to 40% of the total weight of the liquid cleaning composition.

22. The liquid cleaning composition of claim 20, wherein the at least one emulsifying agent is present in an amount of about 8% to 35% of the total weight of the liquid cleaning composition.

23. The liquid cleaning composition of claim 20, wherein the at least one emulsifying agent is present in an amount of about 15% to 30% of the total weight of the liquid cleaning composition.

24. The liquid cleaning composition of claim 1, wherein the at least one emulsifying agent comprises a nonionic surfactant having a hydrophilic moiety portion and a hydrophobic moiety portion with 10 to 50 carbon atoms, the hydrophobic moiety portion conforming to the general chemical formula $—(C_2H_4O)_n—$, where n is a positive integer that is at least 3.

25. The liquid cleaning composition of claim 20, wherein the at least one emulsifying agent comprises:

a first surfactant mixture; and a second surfactant mixture wherein the first surfactant mixture is different than the second surfactant mixture.

26. The liquid cleaning composition of claim 25, wherein the first surfactant mixture comprises an anionic surfactant and a first nonionic surfactant, and the second surfactant mixture comprises a second nonionic surfactant wherein the first nonionic surfactant is different than the second nonionic surfactant.

27. The liquid cleaning composition of claim 26, wherein the anionic surfactant is present in an amount of about 10% to 60% of the total weight of the liquid cleaning composition and the nonionic surfactant is present in an amount of about 10% to 60% of the total weight of the liquid cleaning composition.

28. The liquid cleaning composition of claim 20, further comprising at least one organic substance, other than t-butyl acetate itself, that forms mixtures, together with t-butyl acetate and any other constituents of the cleaning liquid composition, that are molecularly homogeneous solutions and are liquid at 25° C.

29. The liquid cleaning composition of claim 28, wherein the at least one organic substance is selected from the group consisting of hydrocarbons, halohydrocarbons, halocarbons, ethers, and mixtures thereof.

30. The liquid cleaning composition of claim 20, further comprising a coupling agent.

31. The liquid cleaning composition of claim 30, wherein the coupling agent is selected from the group consisting of sodium benzene sulfonate, sodium toluene sulfonate, sodium xylene sulfonate, potassium ethylbenzene sulfonate, sodium cumene sulfonate, sodium octane-1-sulfonate, potassium dimethylnaphthalene sulfonate, ammonium xylene sulfonate, sodium n-hexyl diphenyloxide disulfonate, sodium 2-ethylhexyl sulfate, ammonium n-butoxyethyl sulfate, sodium 2-ethylhexanoate, sodium pelargonate, sodium n-butoxymethyl carboxylate, potassium monophenoxyethyl phosphate, potassium diphenoxyethyl phosphate, sodium mono-n-butoxyethyl phosphate, sodium di-n-butoxyethyl phosphate, triethanolamine trimethylolpropane phosphate, sodium capryloamphopropionate, disodium capryloiminodipropionate, sodium capro imidazoline amphoglycinate, and mixtures thereof.

32. A liquid cleaning composition for cleaning soil from a metallic or plastic substrate, the liquid cleaning composition comprising:

t-butyl acetate;

water; and at least one emulsifying agent selected from the group consisting of poly (5) oxyethylene isodecyloxypropylamine;

a modified coconut diethanolamide surfactant;

octylphenol ethylene oxide condensate;

decyl polyglucoside; and mixtures thereof, wherein the emulsifying agent is present in sufficient quantity to form a stable emulsion of all constituents of the cleaning liquid composition when stored.

33. A liquid cleaning composition for cleaning soil from a metallic or plastic substrate, the liquid cleaning composition comprising:

t-butyl acetate;

water;

a propylene glycol ether coupling agent; and at least one emulsifying agent wherein the emulsifying agent is present in sufficient quantity to form a stable emulsion of all constituents of the cleaning liquid composition when stored.

34. The liquid cleaning composition of claim 33, wherein the propylene glycol ether is selected from the group consisting of diethylene glycol n-butyl ether (DB), ethylene glycol n-butyl ether (EB), ethylene glycol phenyl ether (EPh), propylene glycol n-propyl ether (PnP), propylene glycol phenyl ether (PPh), propylene glycol n-butyl ether (PnB), and mixtures thereof.

* * * * *